US005410762A

United States Patent [19]

Maskovich

[11] Patent Number: 5,410,762

[45] Date of Patent: May 2, 1995

[54] BELT STRAP FOR JOGGER'S COMPACT PORTABLE DEVICE

[76] Inventor: Donald D. Maskovich, 9150 Winding Oak Dr., Fair Oaks, Calif. 95628

[21] Appl. No.: 141,782

[22] Filed: Oct. 22, 1993

[51] Int. Cl.[6] ..... A41F 3/02

[52] U.S. Cl. ..... 2/338; 2/312; 2/322; 224/901; 224/224

[58] Field of Search ..... 2/338, 311, 312, 336, 2/322; 224/203, 224, 222, 229, 901

[56] References Cited

U.S. PATENT DOCUMENTS

| | | | |
|---|---|---|---|
| 2,186,191 | 1/1940 | Beckwith | 2/338 |
| 3,154,787 | 11/1964 | Newman | 2/268 |
| 4,135,653 | 1/1979 | Sieloff | 224/222 |
| 4,432,477 | 2/1984 | Haidt et al. | 224/222 |
| 4,913,326 | 4/1990 | Echelson | 224/222 |
| 5,060,835 | 10/1991 | Payne | 224/224 |

*Primary Examiner*—Clifford D. Crowder

*Assistant Examiner*—Gloria Hale

[57] ABSTRACT

An elastic strap having at least two opposing belt receiving slots through which the free end of a belt is threaded. Preferably, the strap is made of neoprene. The belt receiving slots are reinforced by either grommeting or stitching. The distance between the belt openings is slightly less than the width of the compact portable device which is secured between the outside wall of the belt and the inside wall of the elastic strap. When the belt is tightened around the body of the active wearer, the relative movement of the secured compact portable device and the body is minimized even if the wearer is engaged in vigorous exercise. A second embodiment which features an overlapping elastic strap permits the active wearer to access the control of the compact portable device without interrupting his or her routine. Moreover, the padding of neoprene strap protects the compact portable devices from accidental bumps and knocking against hard objects.

8 Claims, 4 Drawing Sheets

FIG. 5
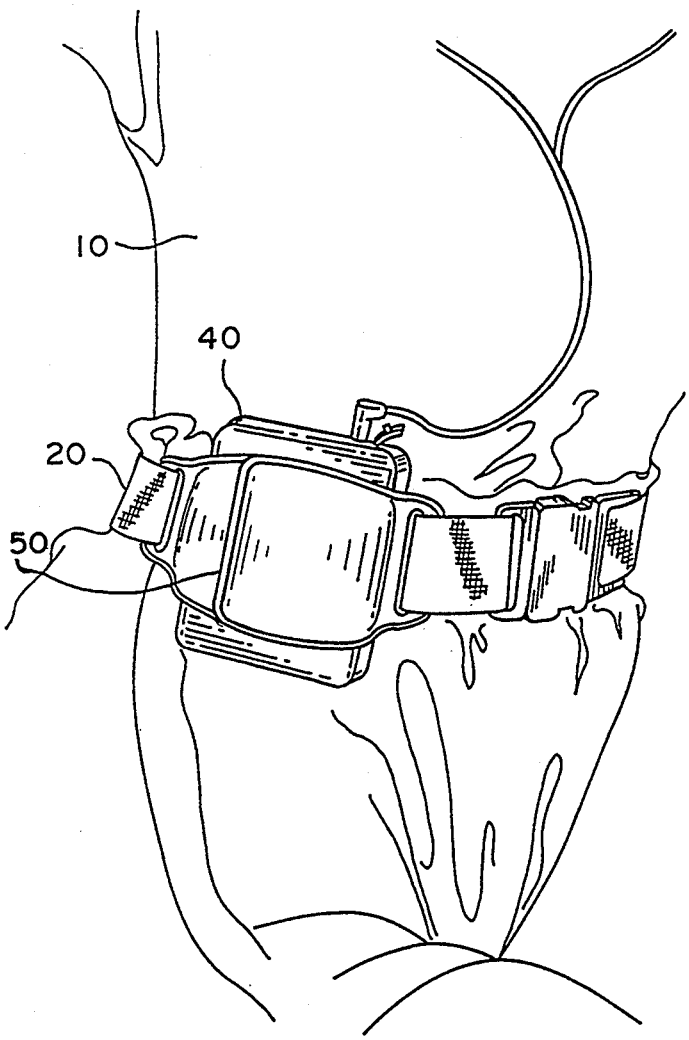
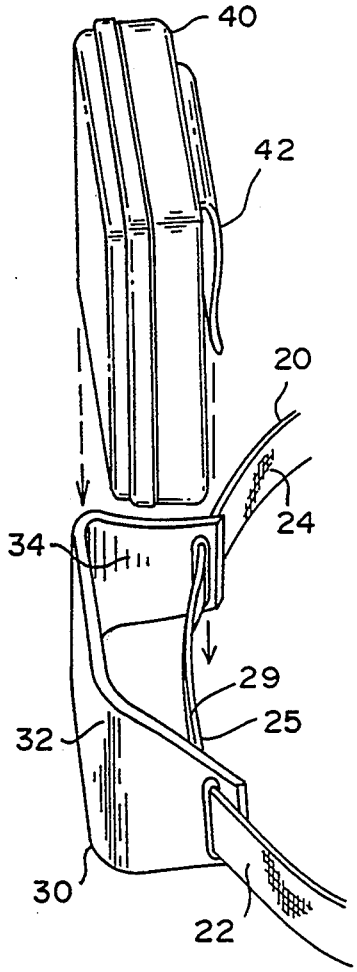
FIG. 4

BELT STRAP FOR JOGGER'S COMPACT PORTABLE DEVICE

BACKGROUND OF THE INVENTION

1. Field of the Invention

The present invention relates to a belt accessory for active wearer to secure compact portable devices while engaging in vigorous activity. Specifically, the present invention describes an elastic strap having at least two belt slots for fastening the compact portable device to an elastic or conventional belt; the active wearer experiences minimum relative movement of the compact portable devices even if the wearer is engaging in vigorous activity.

2. Description of the Related Art

Compact portable devices such as Walkman® cassette player and/or radio receiver (Walkman is a registered trademark of Sony Corporation) are popular with active wearers who listen to audio programs/broadcasts while engaging in vigorous activities such as bicycle riding, aerobics, jogging, skiing and skating. By compact portable device the present invention contemplated compact equipment such as radio receiver, cassette player, compact disc player, cellular telephones, pagers and others. It should be understood by one skilled in the art that compact portable device comes equipped with a hook. When placed on the belt of the wearer, the hook holds the compact portable device in place.

However, active wearers encounter a difficulty with such compact portable devices: when the person exercises or engages in vigorous activity, the movement therefrom often dislodges the hook on the compact portable devices from the wearer's belt. As a result, the compact portable device can be damaged if it falls on a hard surface.

U.S. Pat. Nos. 4,569,465; 4,834,274 and 4,544,089 address certain aspects of the problem of securing compact portable device of an active wearer. '465 discloses an exercise belt adapted to carry a stereo unit on the wearer's body during vigorous exercise. The exercise belt includes a pair of neoprene bands joined together and overlapped to form a symmetrical belt having an elongated open ended sleeve for receiving a stereo unit. Although the '497 exercise belt protects the stereo unit from dust and moisture, gaining access to the controls of the stereo unit is problematic. It follows that the wearer has to interrupt his or her exercise to change radio station or side of a cassette tape.

'274 teaches a tape player holder configured to mount on a conventional belt for securing the tape player. The tape player holder has a rectangular housing and a pivoting cover secured by living hinge to the top wall of the housing. The tape player holder is secured to the belt by snapping together three male and female snap elements disposed on the side wall of the tape player and the belt respectively. It will be appreciated that '274 tape player holder is not suitable for vigorous activity such as jogging and skiing as the prior art does not minimize the relative movement between the body of the wearer and the tape player.

'089 claims a adjustable handgun holster including a strap which is positioned adjustably on a wearer's belt. A bluing protection pad having one end secured to the strap and the other to the side wall of the belt receives and secures handguns of varying sizes. While the '089 adjustable holster accommodates different variety of handguns or even portable devices, its ability to secure items while the wearer is engaging in vigorous exercise is doubtful.

SUMMARY OF THE INVENTION

It is therefore an object of the present invention to provide an apparatus for minimizing the relative movement of the compact portable device and the body of the active wearer.

It is another object of the present invention to provide an apparatus for securing compact portable device of an active wearer by using it in conjunction with an elastic or conventional belt.

It is yet another object of the present invention to provide an durable and lightweight apparatus for securing portable device of an active wearer where the compact portable device comes with a hook.

Accordingly, the present invention describes an elastic strap having at least two belt slots through which the free end of a belt is threaded. Preferably, the strap is made of neoprene. The belt slots are reinforced by either grommeting or stitching. The distance between the belt slots is slightly less than the width of the compact portable device which is secured between the outside surface of the belt and the inside surface of the elastic strap. When the belt is tightened around the body of the active wearer, the relative movement of the secured compact portable device and the body is minimized even if the wearer is engaged in vigorous exercise. A second embodiment of the present invention features an overlapping elastic strap which permits the active wearer to access the control of the compact portable device without interrupting his or her routine. Moreover, the padding of neoprene strap protects the compact portable device from accidental bumps and knocking against hard objects.

BRIEF DESCRIPTION OF THE DRAWINGS

FIG. 4 is a side, perspective view of the present invention in accordance with FIG. 3.

FIG. 5 illustrates a perspective view of a wearer carrying a compact portable device being secured on a belt with a second embodiment of the present invention.

DETAILED DESCRIPTION OF THE INVENTION

Figure 1:
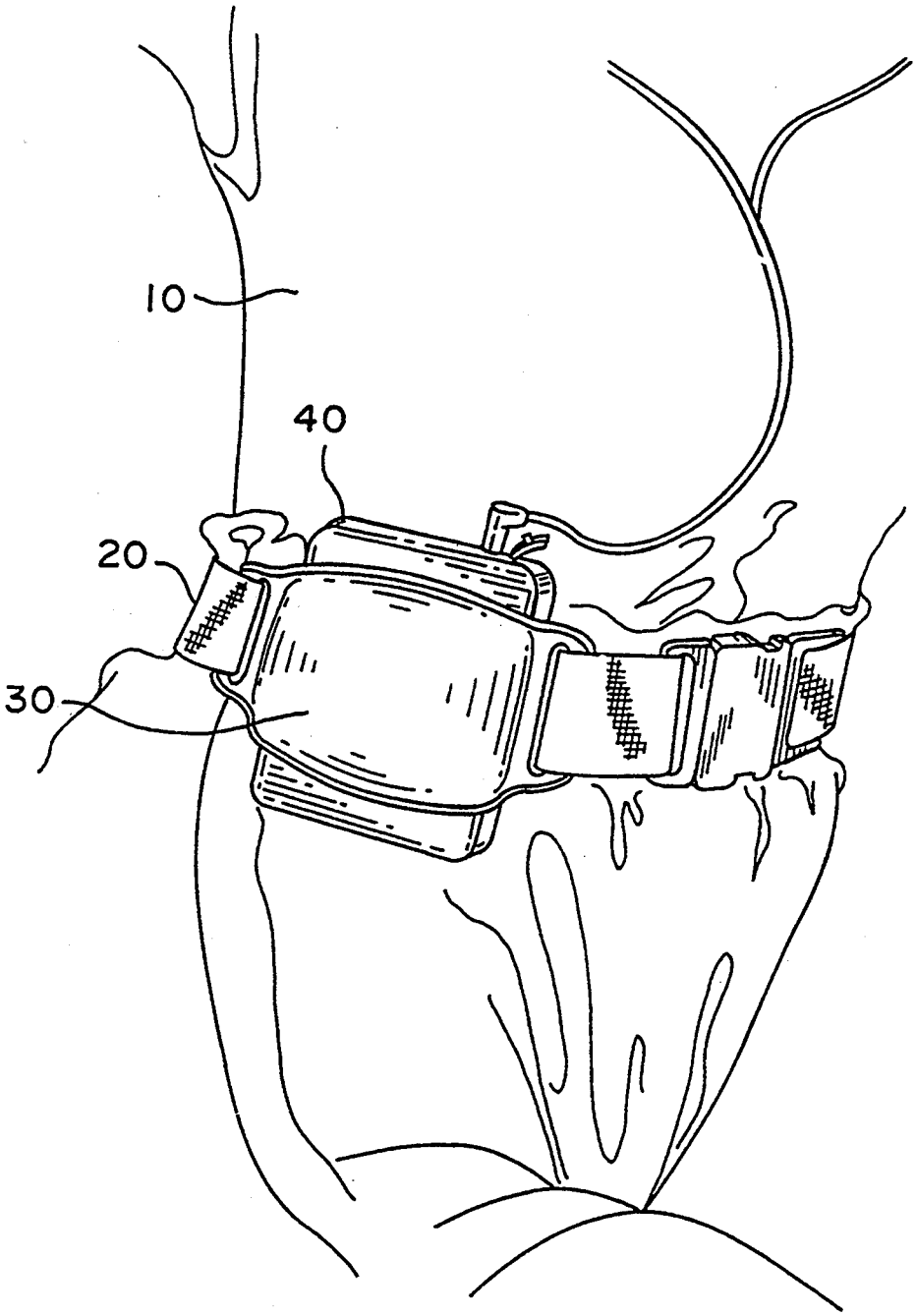
FIG. 1 shows a perspective view of a wearer carrying a compact portable device being secured on a belt with a first embodiment of the present invention.

FIG. 1 shows a perspective view of an active wearer 10 carrying a compact portable device 40 around his or her waist. The compact portable device is being secured between a belt 20 and an elastic strap 30 of the first embodiment of the present invention. Although the present invention is shown strapped on the side of the wearer's waist, the elatic strap 30 may be positioned for example on the front or back or either side of the wearer's waist.

Figure 2:
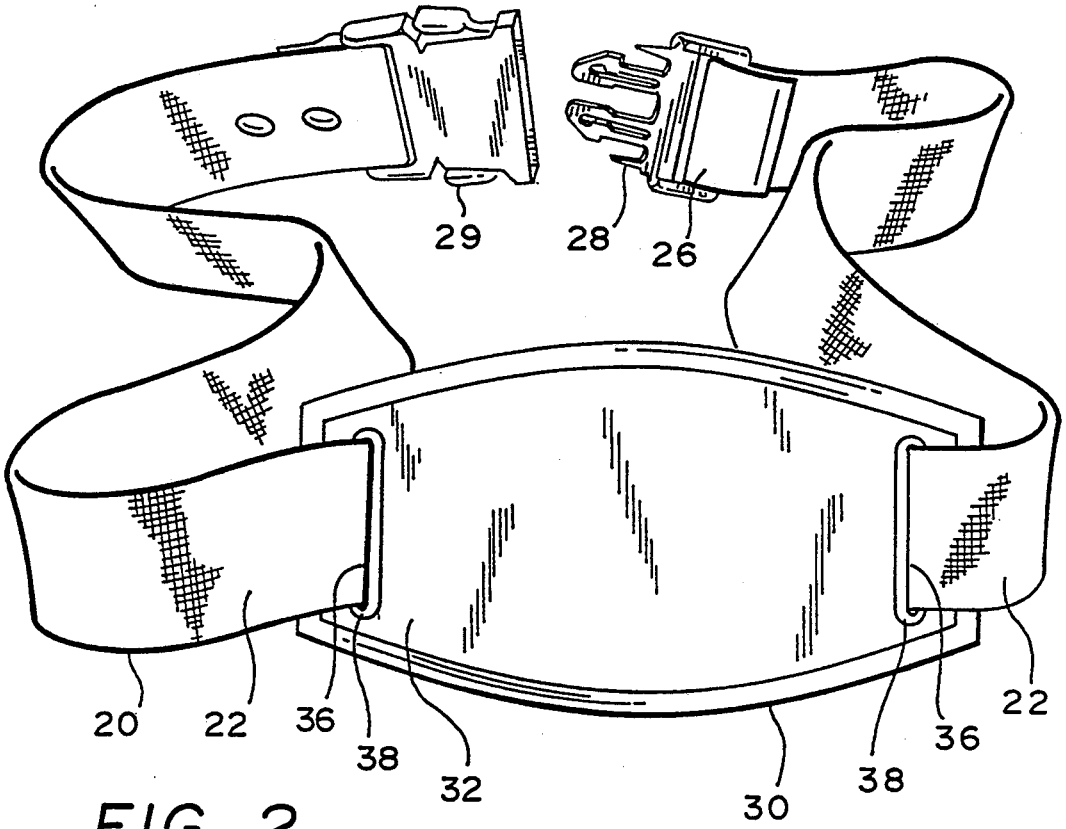
FIG. 2 is a front, perspective elevational view of the first embodiment of the present invention as a belt is threaded through its belt openings.

FIG. 2 is a front, perspective elevational view of the present invention as an elastic belt 20 is threaded through the belt receiving slots 36. The elastic strap 30 of the first embodiment of the present invention comprises a flat and substantially symmetrical piece of elastic material. Preferably the elastic material is neoprene. The elastic strap 30 has an outer surface 32, an inner surface 34; the elastic strap also has at least two belt receiving slots 36 substantially along its longitudinal axis and symmetrical about its vertical axis. The belt receiving slots are reinforced in a manner elaborated in the description of FIG. 3. The belt 20 terminates in a free end 26. The belt 20 has preferably a side release buckles (male buckle 28 and female buckle 29). The belt 20 has an outer side wall 22 and an inner side wall 24. By convention, the inner surface 24 refers to that side of the belt which is closer to the body of the wearer. Naturally, the outer surface 22 is the side that is further away from the body of the wearer. It should be understood by one skilled in the art that there are reversible belts which can convert the inner surface 24 into the outer surface 22.

Figure 3:
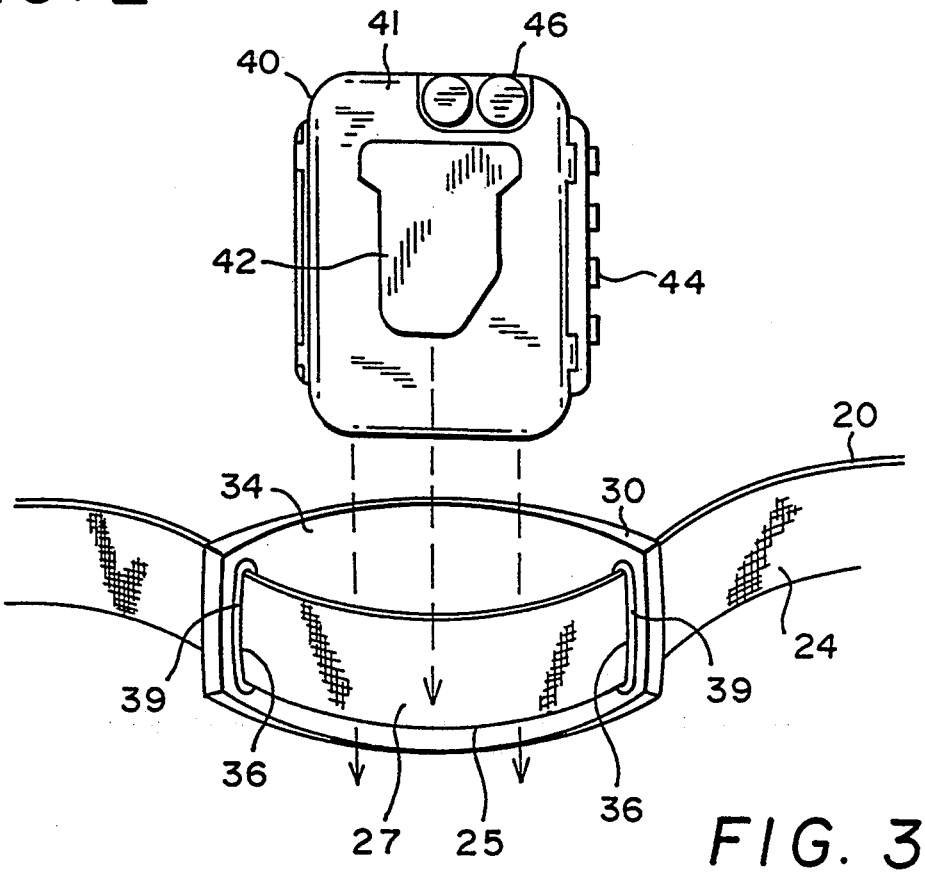
FIG. 3 is a rear, perspective elevational view of the first embodiment of the present invention as a belt is threaded through its belt slots to secure a compact portable device which comes with a hook.

FIG. 3 is a rear, perspective elevational view of the first embodiment of the present invention as the belt 20 is threaded through the belt receiving slots 36 to secure a compact portable device 40 which comes with a hook 42. The inner surface 34 of the elastic strap 30 is shown and the inner surface 24 of the belt 20 is threaded through the belt receiving slots 36. The belt receiving slots 36 are each reinforced with a grommet 39 being either bonded or stitched around the edge of the slot 36. The section of the belt 20 between the belt receiving slots 36 of the present invention is designated as belt section 25. This belt section has an outer surface 23 (not shown in FIG. 3) and an inner surface 27. The compact portable device 40 is secured between the inner surface 34 of the elastic strap and the outer surface 23 (not shown) of the belt 20 while the hook 42 is engaged over the inner surface 27 of the belt. FIG. 4 is a side, perspective view of the present invention in accordance with FIG. 3. Preferably, the distance between the belt receiving slots is slightly less than the width of a compact portable device. When the belt 20 is buckled or tightened around the waist of an active wearer, the elastic strap 30 restraints the compact portable device from any laterial movement by virtue of the friction between the elastic strap and the surface of the compact portable device. Furthermore, the reinforced belt receiving slots also reduce any movement along the longitudinal axis of the belt. Finally, the hook 42 prevents the compact portable device from moving vertically as it is clipped and lodged on the belt section 25. Thus, the first embodiment of the present invention minimizes the relative movement of the compact portable device and the wearer's body even if the wearer is engaging in vigorous exercise. If the belt 20 is made of elastic material, the wearer feels even less of the compact portable device because the weight and minor movement of the compact portable device is counterbalanced by the elastic strap and the elastic belt. It should be understood by one skilled in the art that conventional leather or clothe or synthetic belt may be used in conjunction with the first embodiment of the present invention. However, the relative movement between the compact portable device and the wearer's body may be more than the case where an elasticized belt is used.

For a typical Walkman® cassette player, an elastic belt of 3.8 cm in height and 3.0 mm in thickness. The recommended thickness of the elastic strap is 5.0 mm and comprises of sponge neoprene.

FIG. 5 illustrates a front, perspective view of a wearer carrying a compact portable device being secured on a belt with a second embodiment of the present invention. With the exception of an elastic strap 50, all the items in FIG. 5 is the same as that in FIG. 1. The details of the second embodiment of the present invention shall be described in FIGS. 6–7. The second embodiment of the present invention permits the active wearer to access the compact portable device without diminishing the strap's ability to minimize the relative movement between the compact portable device and the wearer's body.

Figure 6:
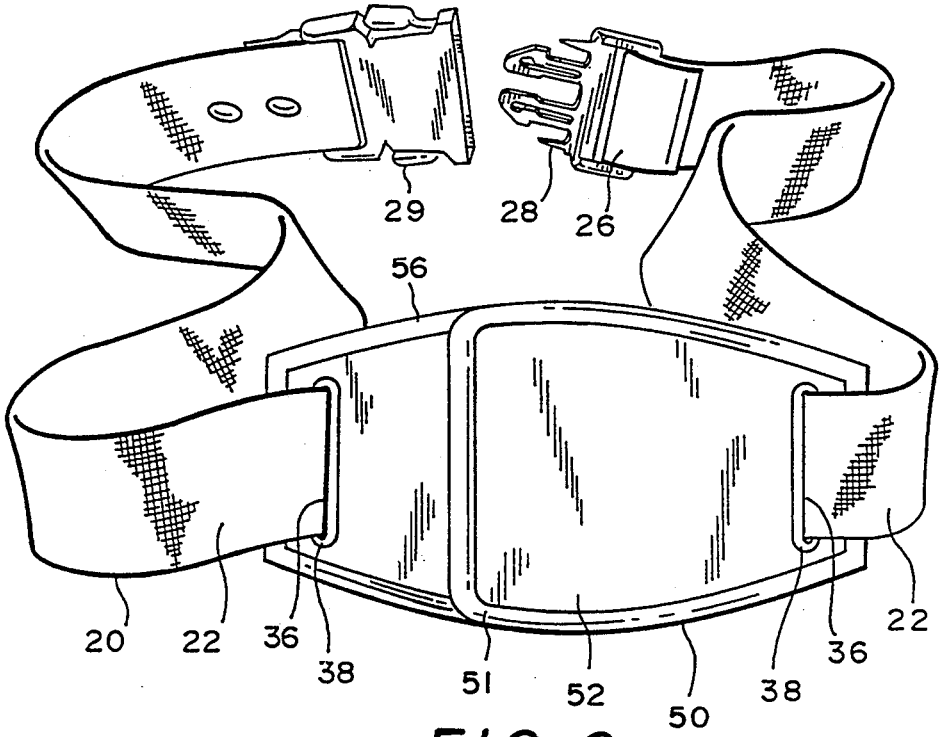
FIG. 6 is a front, perspective elevational view of the second embodiment of the present invention as a belt is threaded through its belt slots to secure a compact portable device which comes with a hook.

FIG. 6 is a front, perspective elevational view of the second embodiment of the present invention as a belt is threaded through the belt receiving slots. The elastic strap 50 is an unitary piece of neoprene or equivalent material having two free ends 51 and 56 respectively. The free end 51 overlaps the free end 56. At the same time, the elastic strap 50 has at least two belt receiving slots 36 which are reinforced just as the belt openings of the elastic strap 30 in the first embodiment of the present invention. The free end 51 has outer surface 52 and inner surface 53 (not shown in FIG. 6) while the free end 56 has outer surface 55 (partially hidden by the overlapping free end 51) and inner surface 57 (not shown).

Figure 7:
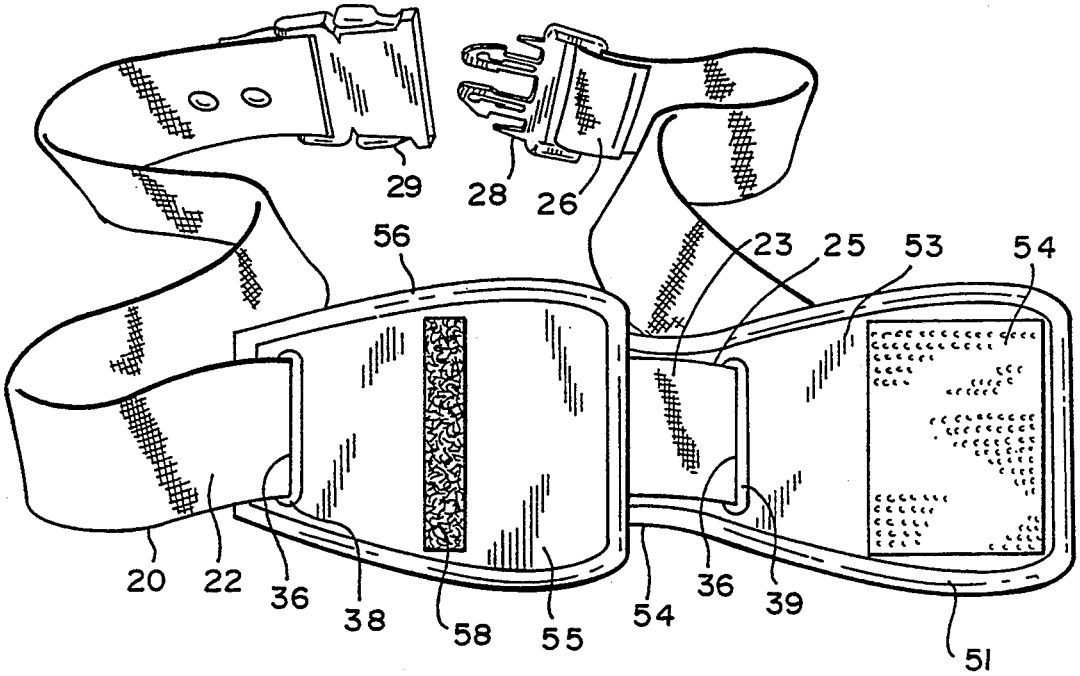
FIG. 7 is a front, perspective elevational view of the second embodiment of the present invention having overlapping straps which allows the wearer to access the compact portable device.

FIG. 7 is a front, perspective elevational view of the second embodiment of the present invention having overlapping ends 51 and 56 which allows the wearer to access the compact portable device. The free end 51 is coupled to the other free end 56 with section strap 54. The free ends extend outwardly from the belt receiving slots so that the wearer can access the controls of the compact portable device. Together the free end 51, the section strap 54 and the free end 56 forms an elastic strap of the second embodiment of the present invention. When the free end 26 of the belt 20 is threaded through the belt receiving slots 36 on the elastic strap 50, the belt section 25 is substantially parallel with the section strap 54. The strap 54 is preferably a hook and loop fastener is either bonded or sawn on an substantial area of the inner surface 53 of the free end 51 for fastening onto the outer surface 55 of the free end 56. Optionally, a section of loop fastener fastening strap (preferably clothe surface) may be disposed onto the outer surface of the free end 56 for improving the grip of the overlapping free ends. It should be evident to those skilled in the art that a compact portable device may be secured between the overlapping free ends and the belt section when the free ends are closed. Similarly, the wearer can access the compact portable device by simply opening the overlapping free ends. For the purpose of re-securing the compact portable device, the wearer merely has to place the hook of a compact portable device onto the section belt 25, pull the free end 56 over the compact portable device and pull the other free end 51 in the opposite direction in order to engage the hook fastener fastening strap over the neoprene surface. It follows that the second embodiment of the present invention not only allows the wearer to secure the compact portable device with an elastic belt with minimium relative movement of the compact portable device, but also the wearer can access the compact portable device and re-secure the same. Moreover, the wearer can shift the position of the elastic strap 50 around the belt 20 easily. For instance, the wearer may want to change the position from the side of the waist to the front of the wearer should the compact portable device obstruct the exercise movement of the wearer.

While the present invention has been described particularly with reference to FIGS. 1 to 7 with emphasis on an apparatus for minimizing the relative movement between compact portable device and the active wearer's body, it should be understood that the figures are for illustration only and should not be taken a limitation on the invention. In addition, it is clear that the apparatus of the present invention has utility in many applications where securing compact portable device to a belt is required. It is contemplated that many changes and modifications may be made by one of ordinary skill in the art without departing from the spirit and the scope of the invention as described.

I claim:

1. An apparatus for securing a compact portable device relative to an active wearer's body, comprising:

an elastic belt;

an elastic strap having at least two opposing belt receiving slots for permitting a free end of said belt to be threaded therethrough, said elastic strap and said belt defining an open ended vertical space such that movement of a compact portable device which may be positionable therebetween is restrained when said belt is tightened; and a grommet for reinforcing each said belt receiving slots, the peripherals of said grommet being bonded along the edge of said belt receiving slots for minimizing wear and tear on said slots notwithstanding repeated uses, wherein, relative movement between said compact portable device and the active wearer's body is minimized.

2. The apparatus as in claim 1 wherein said elastic strap comprises neoprene.

3. The apparatus as in claim 1 wherein the distance between said belt receiving slots is slightly less than the width of said compact portable device.

4. An apparatus coupled to a belt for minimizing the relative movement between a compact portable device and an active wearer's body when a compact portable device is secured between said apparatus and said belt, said apparatus comprising:

an elastic strap having at least two opposing belt receiving slots for permitting a free end of said belt to be threaded therethrough, said elastic strap further having first and second free ends extending outwardly from said belt receiving slots for allowing access of controls of the compact portable device without effort; and a grommet for reinforcing each said belt receiving slots, the peripherals of said grommet being bonded along the edge of said belt receiving slots for minimizing wear and tear on said slots notwithstanding repeated uses.

5. The apparatus as in claim 4 wherein said elastic strap comprises neoprene.

6. The apparatus as in claim 4 wherein said first free end has hook and loop fastening strap disposed on the inner surface for securing said compact portable device to said belt when said first free end is overlapped and closed over the outer surface of said second free end.

7. The apparatus as in claim 4 wherein the distance between said belt receiving slots is slightly less than the width of said compact portable device.

8. The apparatus as in claim 4 wherein said belt comprises of elastic material.

* * * * *